US011371260B2

(12) United States Patent
Garcia Lopez et al.

(10) Patent No.: US 11,371,260 B2
(45) Date of Patent: Jun. 28, 2022

(54) MECHANICAL LOCK WITH DISCRIMINATED OPENING VIA CONTROL FOR A PLURALITY OF KEYS THAT CAN BE AUTHORIZED AND SYSTEM FOR RECEIVING PARCELS THAT INCLUDES SAME

(71) Applicants: Maria Ruth Garcia Lopez, Madrid (ES); Alberto Matamoros Munoz, Madrid (ES)

(72) Inventors: Maria Ruth Garcia Lopez, Madrid (ES); Alberto Matamoros Munoz, Madrid (ES)

( * ) Notice: Subject to any disclaimer, the term of this patent is extended or adjusted under 35 U.S.C. 154(b) by 295 days.

(21) Appl. No.: 16/762,705

(22) PCT Filed: Oct. 23, 2018

(86) PCT No.: PCT/ES2018/070690
§ 371 (c)(1),
(2) Date: May 8, 2020

(87) PCT Pub. No.: WO2019/097098
PCT Pub. Date: May 23, 2019

(65) Prior Publication Data

US 2021/0172201 A1 Jun. 10, 2021

(30) Foreign Application Priority Data

Nov. 16, 2017 (ES) ..... ES201731330

(51) Int. Cl.
*E05B 37/00* (2006.01)
*E05B 35/08* (2006.01)
*E05B 65/02* (2006.01)

(52) U.S. Cl.
CPC ..... *E05B 37/0031* (2013.01); *E05B 35/083* (2013.01); *E05B 37/0034* (2013.01); *E05B 65/025* (2013.01); *E05Y 2900/602* (2013.01)

(58) Field of Classification Search
CPC ..... E05B 35/083; E05B 35/10; E05B 35/105; E05B 37/0031; E05B 37/0034; E05B 37/0041; E05B 65/025
See application file for complete search history.

(56) References Cited

U.S. PATENT DOCUMENTS 714,458 A * 11/1902 Dalton et al. ..... E05B 37/0031 70/284
1,251,177 A * 12/1917 Brintnall et al. ..... E05B 35/083 70/385

(Continued)

*Primary Examiner* — Christopher J Boswell

(57) ABSTRACT

The invention relates to a mechanical lock (37) for a plurality of keys (26) that can be authorized with a different code (39), with discriminated opening using a selection device (1) that can be activated manually from outside, a signaling element for displaying the selected code (2) (3), a manual closure (4) and locking (19) (15) mechanism, integrated with a modular set of lockers (FIG. 15) for delivery home and collection of parcels. The invention allows the use of a limited number of modular lockers for a larger set of users without requiring computer applications, electricity or an internet connection during the delivery, which is especially for common areas of communities of residents, building lobbies, housing estates, shared spaces or offices.

7 Claims, 10 Drawing Sheets

(56) References Cited

U.S. PATENT DOCUMENTS

| | | | | | |
|---|---|---|---|---|---|
| 1,431,381 | A * | 10/1922 | Diesel | E05B 35/083 | 70/385 |
| 1,549,581 | A * | 8/1925 | Lewis | E05B 35/083 | 70/385 |
| 1,561,207 | A * | 11/1925 | Benham | E05B 35/083 | 70/385 |
| 1,573,741 | A * | 2/1926 | Parent | E05B 35/083 | 70/385 |
| 2,221,664 | A * | 11/1940 | Susser | E05B 35/083 | 70/384 |
| 3,983,728 | A * | 10/1976 | Phillips | E05B 35/125 | 70/383 |
| 5,502,990 | A * | 4/1996 | Hirvi | E05B 35/083 | 70/354 |
| 5,775,143 | A * | 7/1998 | Mauer | E05B 35/083 | 70/355 |
| 7,367,207 | B2 * | 5/2008 | Yang | E05B 37/0034 | 70/284 |

* cited by examiner

MECHANICAL LOCK WITH DISCRIMINATED OPENING VIA CONTROL FOR A PLURALITY OF KEYS THAT CAN BE AUTHORIZED AND SYSTEM FOR RECEIVING PARCELS THAT INCLUDES SAME

FIELD OF THE INVENTION

The invention consists of a mechanical lock of special characteristics to be used in a modular set of parcel delivery and reception lockers shared by a large set of users.

DESCRIPTION OF THE PRIOR ART

Locks usable at modular sets of parcel delivery and reception lockers or compartments are well known in the art. These locks can be opened either mechanically or electromagnetically.

On the other hand, lockers locks can be operated by a single code that authorizes the opening (for example, with a key, a special key, an identifier, a card, a combination of numbers, keys or letters, . . . ); or by means of several authorized opening codes (for example, a master key, a regular key, or several conventional keys that open the same lock, several electromagnetic keys or cards that open the same lock, etc.). There are two possibilities among those locks with several opening authorized codes: first, that each and every one of the codes can operate the lock, also called indiscriminate opening (master key-regular key); second, that only one of all codes that can be authorized can operate the lock at a certain time, also called discriminated opening (electromagnetic opening keys or electromagnetic cards).

The locks for modular sets of lockers or compartments that have several codes and require a discriminated selection to authorize a single code among all of the possible codes use electromagnetic, electrical or computer methods that allow the temporarily opening to the authorized user.

As a result of the current state of the locks art, there are various delivery and reception of parcels forms and systems, among which we find:

- Delivery of parcels at the door of each address. (in person-no lock).
- Delivery of parcels at post offices or delivery centers opened at certain more or less extensive business hours. (in person-no lock).
- Delivery of parcels through a parcel mailbox or storage not shared by each of the users in a home or workplace. These mailboxes require a large amount of available space for each user, which requires a significant decrease in the volume of each locker, large packets cannot be delivered, and unnecessarily amount of space in community areas is taken. In general terms, this storage system requires a lock with a single opening code for each compartment module. (mechanical or electromagnetic lock—one code).
- Delivery of parcels through a shared parcel storage with a single key fixed to the lock when it is open and removable only when the lock is closed. Once closed, the messenger itself is required to take out the key and put it through the mailbox slip exclusive for each users. The user will find the parcel shared storage key when the mailbox is opened and will proceed to open the lock and pick up the parcel. This system requires a lock that authorizes the opening to a single mechanical code and sharing this only code key. (mechanical lock—one code-possession of discriminated key).

- Automated parcel delivery in public spaces and places not attended in person and without business hours restrictions. This case has an automated system with electromagnetic identity recognition locks and parcel validation codes, automated opening of storage compartments, managed through one or more parcel companies. This system necessarily requires a lock that can operate in a discriminated way several opening codes requiring electromagnetic, computer methods and internet connection. They are usually located in transport stations and gas stations with or without schedule restrictions. (automatic lock—several codes-discriminated opening).
- Automated parcel delivery in a locker by means of a hanging electromagnetic opening padlock, with parcel label code reader and a phone app. This system requires the padlock to authorize the opening through an app that reads the code printed on the parcel and allows the messenger to open the padlock to leave the parcel. The padlock user can open it with the phone app. This padlock has an administrator and one or more users. The logistics provider forwards parcels to computerized padlocks where the user has been indicated. They are usually used at the entrance of single-family residences and are not usually shared as they ultimately depend on an administrator. (automatic lock—one or more codes—discriminated opening).

As it is well known in the art, mechanically operated safety locks generally have a unique code set during the assembling of parts. U.S. Pat. No. 690,537 shows a housing, deadbolt plates and some interlockings capable of being coupled by the swinging motion of the key with the authorized mechanical code, which raises the interlocks to the proper height and allow the movement of the deadbolt in the opening direction. This lock, for example, being of a single authorizing code, is capable of change with the help of a changing blade during the assembly of parts. U.S. Pat. No. 5,502,990 also has the same structure and relationship of parts with a changeable authorizing code but improving safety. U.S. Pat. No. 1,693,731 has, with the same elements, a changeable combination with another key without disassembling the lock. The state of the art has managed to authorize several simultaneous or indiscriminate opening codes, or modify the codes by opening the housing, by a regular or a special key, but in either case, there is no mechanism capable of authorizing a set of codes that manually discriminates which code can open the lock at a specific time. To fulfill the need of allowing a set of users to open in a discriminated manner the same lock in a shared receiving and collecting parcel system, automatic electromagnetic opening systems are generally used together with electrical and computerized authorization methods.

SUMMARY OF THE INVENTION

The present invention has the aim of redesigning a changeable mechanical lock in such a way so that it can be operated with a plurality of codes, but in a discriminated and manual way. A single code among all the possible codes can open the lock at a specific time and become available again for the next recoding and delivery. Moreover, the lock requires the manual closing of the lock after the user has been selected.

This is achieved by including in a safety lock a user selection device from the outside which through movement causes the mechanical change of the opening authorizing code, the redesign of the combination plates allowing its ascending and descending movement, the inclusion of continuous movement restriction elements to set a certain position of the plates for each user and a locking device for the selection mechanism once closed. In order to allow the messenger to manually close the lock having previously selected the user, some locking elements usually included in security locks have been removed. By moving the deadbolt slide with a stem any parcel supplier manages to close the locker; and finally, to allow the user to see if there is a parcel available without the need for electronic systems or computer applications, selection user and availability indicators have been included, that depend on the displacement path of the deadbolt.

The lock is included in a modular variable-size locker system, with the same lock for each module of the same address and with the assignment of a different key for each user sharing the modular system. The messenger or supplier places the parcel in one of the lockers whose dimension are most appropriate to the volume of the parcel. If the most appropriate locker is taken, the messenger deposits the parcel in the closest one to the volume of the parcel. Then the user to which the parcel is directed is selected and the lock deadbolt is manually closed with the pin, until it locks. The selection and indication device will indicate the floor or user who can open the locker. Once it is closed it can only be opened with the key whose mechanical code corresponds to that selection. All other keys to the same lock are not authorized to open that lock.

Therefore, the invention has a number of advantages, namely that with few storage modules a plurality of users are serviced, parcels, of variable dimension and great weight can be received at any time at home, without the addressee being present or assisted, without using telecommunications devices and computer applications, without having software or devices up-to-date, without electricity, eco-friendly, easy to open, with a mechanical code key for personal use and keeping the storage exclusivity with respect to other users until collection; and conversely, the delivery or return of the user is allowed to one or more parcel logistics suppliers with the same exclusivity and security.

Other characteristics and advantages of the present invention are derived from the following detailed description of an illustrative and non-limiting embodiment of its object in relation to the accompanying figures.

BRIEF DESCRIPTION OF DRAWINGS

To understand the nature of the invention, a preferred industrial realization of the present invention is illustrated in the attached drawings, by way of a not limiting and merely illustrative example, to which we refer in our description.

DETAILED DESCRIPTION OF THE INVENTION

Making reference to the attached figures, and according to the numbering system adopted, an example of a preferred embodiment of the present invention can be noted, comprising the parts and elements indicated and described below.

Thus, as seen in FIGS. 1 to 16 a possible preferential embodiment of the invention comprises the following elements.

Figure 1:
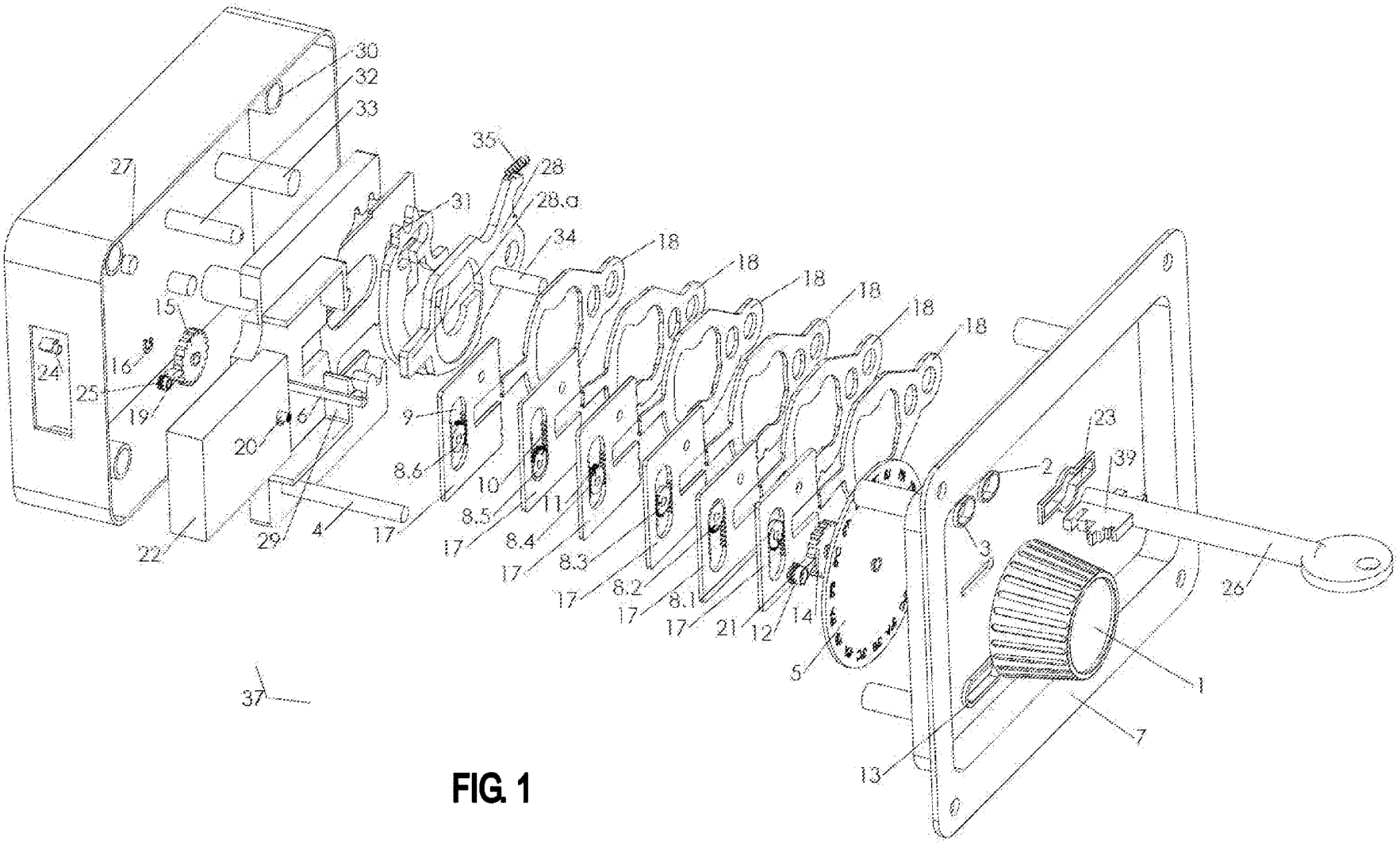
FIG. 1 is an exploded perspective view of the lock pieces in accordance to the preferred embodiment of the invention.

The selection device for opening discrimination goes through the deadbolt (22) by means of a drive shaft (6) that is driven by a knob (1) modifying the position of the plates (17) by means of the combination gears (8), waiting for the manual closing of the lock by the rod (4), as well as its subsequent opening by a key (26) that is inserted into the keyhole (23) of the lid. The key rotates coupling the necessary elements to release the deadbolt (22), as shown in FIG. 1 and explained in detail below.

Figure 2:
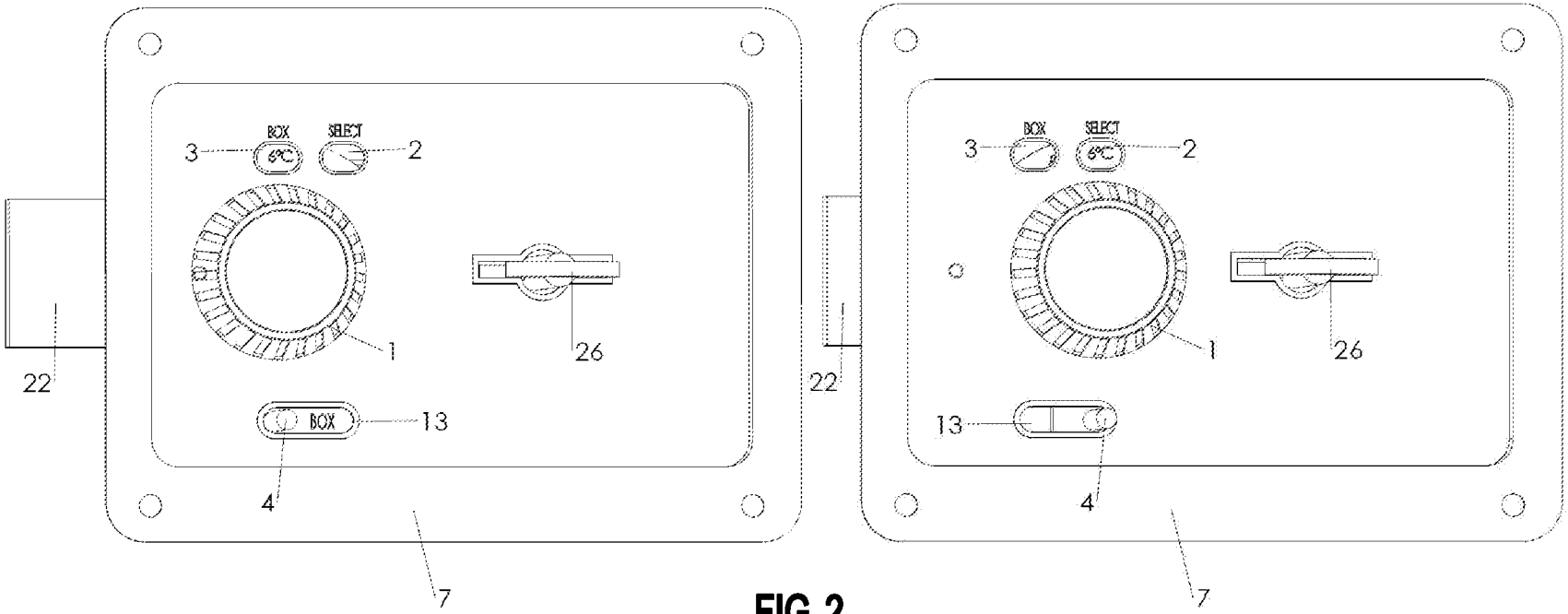
FIG. 2 is a front view of the lock in the closed (left) and open position (right)

The destination indication window (3), as shown in FIG. 2 (left), warns which user has been chosen by the messenger. The selection indication window (2), in FIG. 2 (right), indicates which of the potential users is being selected by clockwise turning the selection knob (1). When the messenger finds the user to which the parcel is intended, he/she moves the closing rod (4) to its end, locking the lock and appearing in the destination indication window (3). In turn, the word "BOX" appears on the right side of the slit (13) of the closing rod (4). On the left side of FIG. 2 the front of the lock in a closed position is shown, and on the right side of FIG. 2 the front of the lock in its open position is shown.

Figure 3:
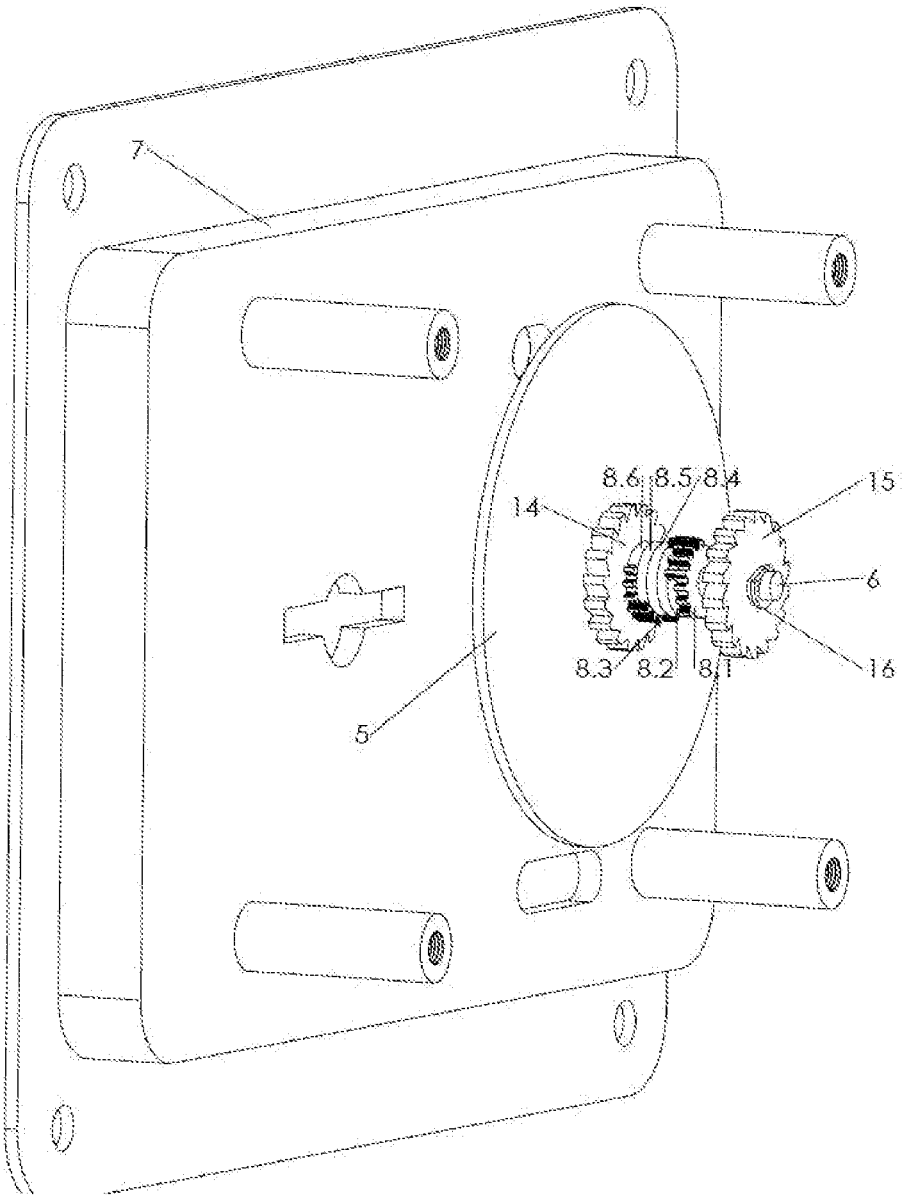
FIG. 3 shows a perspective view of the back of the lid and the selection device, omitting some parts of the lock for clarity purposes.

The drive shaft (6) goes through the cover (7) and the users wheel (5), as shown in FIG. 3, including longitudinal and transverse cuts, to assemble the combination gears (8.1) (8.2) (8.3) (8.4) (8.5) (8.6) and the continuous circular motion restriction elements, the ratchet (14), the closing ratchet (15) and the safety washer (16). The first circular motion restriction element, called for these purposes ratchet (14), has two functions: the first one is to restrict one of the turning direction to force the clockwise rotation (it is thus a ratchet-shaped piece with oblique teeth); and the second function is to transform the continuous circular movement of the selection knob (1) into a discrete circular motion, a movement in steps, one for each of the users who share the lock and the lockers, having as many teeth as users.

Figure 4:
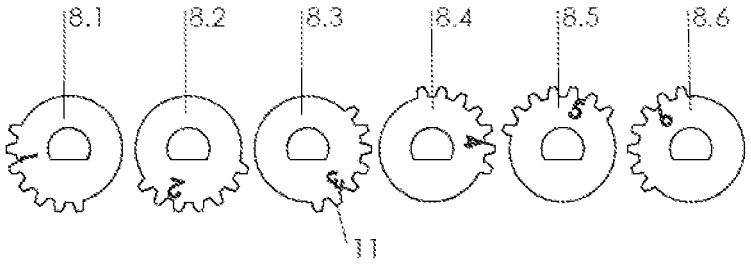
FIG. 4 shows an elevational view of the combination gears without being assembled in the selection device, in order to give greater clarity to the explanation of possible permutations.
Figure 5:
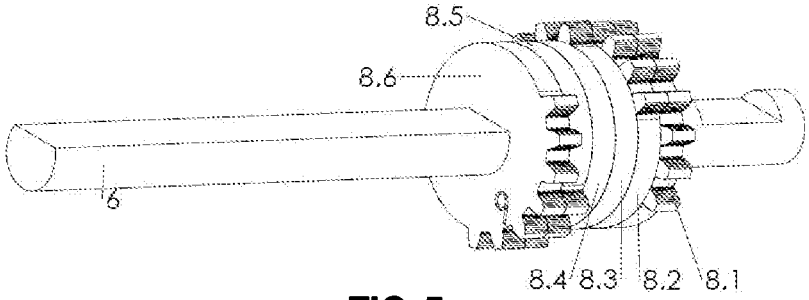
FIG. 5 is a perspective detailed view of the assembly of a possible combination of the combination gears.

The combination gears (8.1) (8.2) (8.3) (8.4) (8.5) (8.6) have toothed arcs (11) of varying degrees that are attached to the drive shaft (6), as shown in FIG. 4. Each gear has an engraved consecutive natural number. These gears have the aim to configure, through their permutation with respect to the relative placement on the drive shaft (6), the general combination of the lock. A position of the combination gears (8.1) (8.2) (8.3) (8.4) (8.5) (8.6) configures a set of different mechanical codes for each rotation degree. The location of these same parts in another relative position determines other mechanical codes for the same rotation degrees. The consecutive natural numbers engraved on each of the combination gears, as shown in FIG. 5, helps in the assembling of the parts during the industrial manufacturing process.

Figure 6:
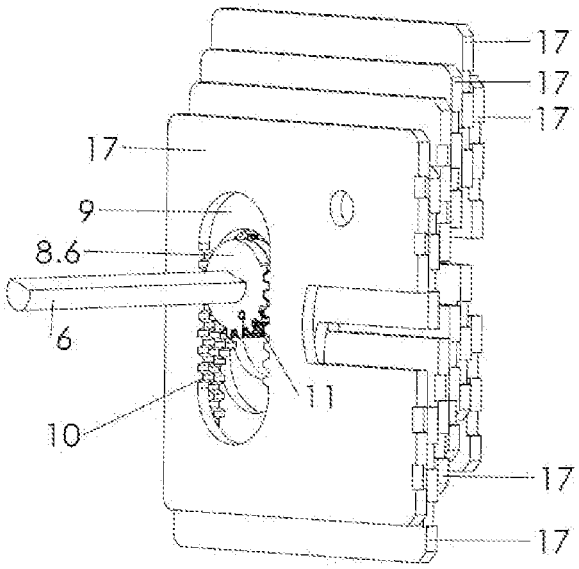
FIG. 6 shows a perspective detailed view of the assembly between the plates and the combination gears inserted into the combination shaft, in order to represent the linear movement of the plates, up and down, as the shaft of the combination cylinder rotates, omitting part of the lock for clarity purposes.

Each plate (17) has a rectangular rounded-end hole (9) with inner and rack teeth (10) coupled with the toothed arches (11) of the combination gears (8.1) (8.2) (8.3) (8.4) (8.5) (8.6), as shown in detail in FIG. 6. The circular turning motion of the drive shaft (6) is transformed into a linear up and down motion of the plates (17). Each turning degree of the drive shaft (6) that allows the step-by-step movement of the selection knob (1) determines a variation, also in steps, of the respective heights of the plates (17). These respective heights of the plates (17) as a result of the different turning degrees configure each of the specific combinations of each key that the set of users that shares the lock have, and the relative position of the positioning gears (8.1) (8.2) (8.3) (8.4) (8.5) (8.6) on the drive shaft (6) configures the general combination of that lock. The drive shaft (6) passes through the deadbolt (22) and joins the selection knob (1). The end portion of said drive shaft (6) has a slit to insert a safety washer (16), and the initial portion of said drive shaft (6) is attached to the selection knob (1). The selection knob (1), like the rod (4), has the possibility to move the deadbolt laterally (22).

Figure 7:
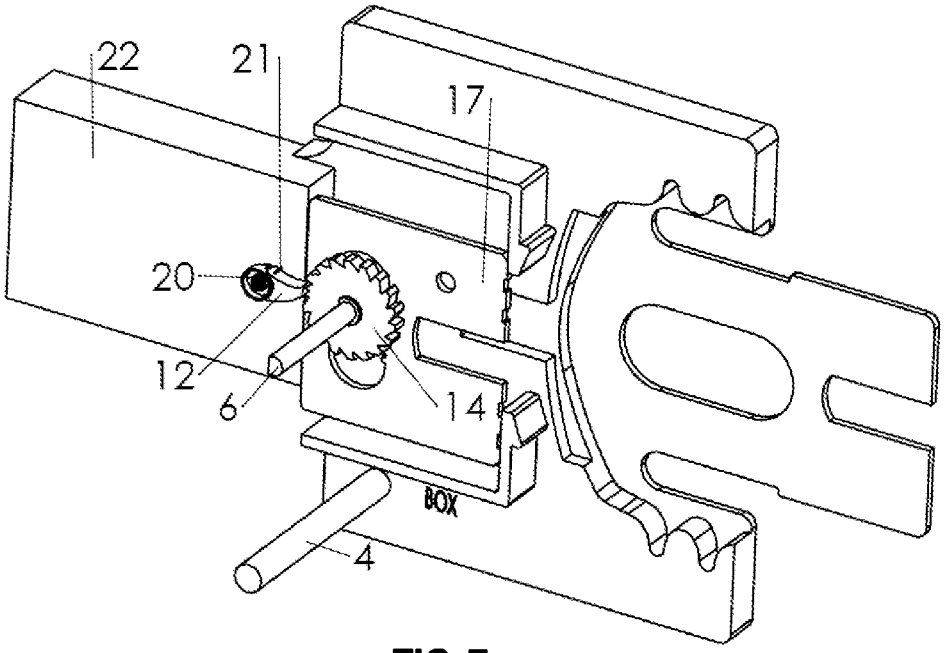
FIG. 7 represents a perspective view of the deadbolt with the turning direction restriction device and circular step by step movement, by contacting the ratchet and the pawl, omitting part of the lock for clarity.

The piece that includes the deadbolt (22) has a guiding stem (20) housed therein, as shown in FIG. 1, to attach the turning direction restriction pawl (12) (also called the dextrorotation pawl) which prevents the counterclockwise rotation, as shown in FIG. 7. This pawl has a hole that matches the guiding stem (20), to which a spring has been added (21) whose function is to force contact with the ratchet (14). The guiding stem (20) includes a thread to facilitate the installation of the turning direction restriction pawl (12). The drive shaft (6) shall therefore have a counter-clockwise rotation restriction according to the ratchet (14).

Figure 8:
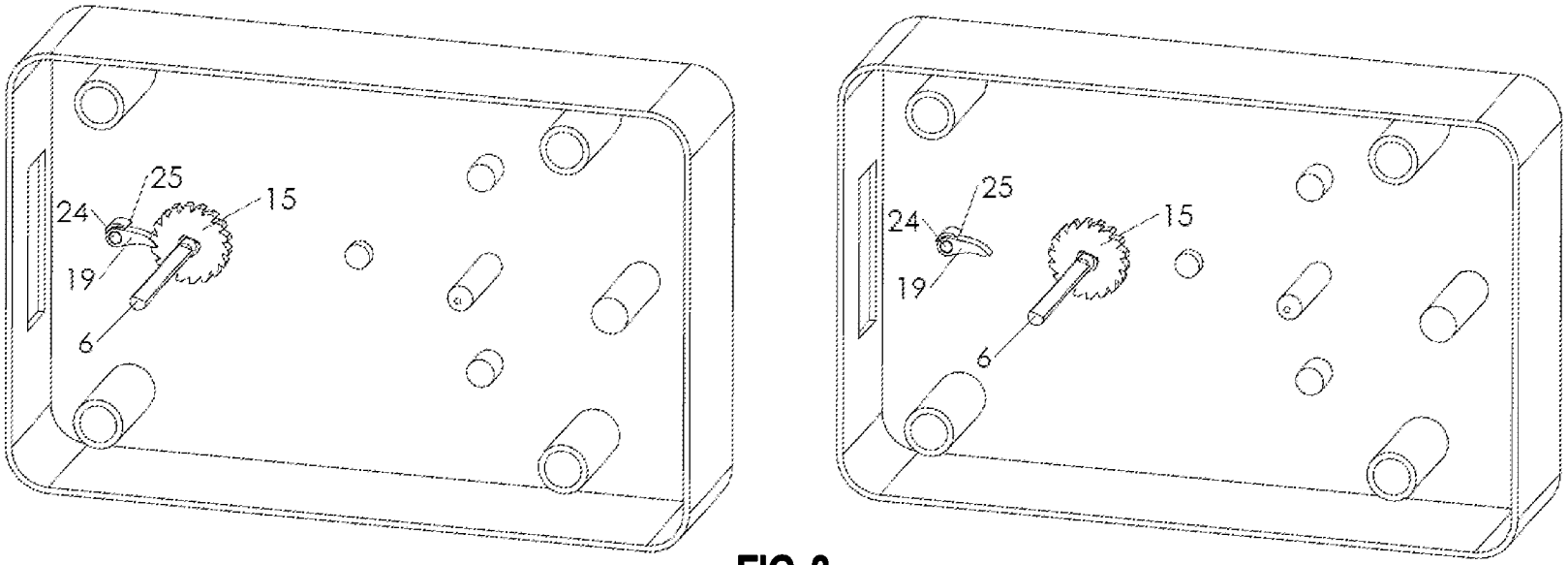
FIG. 8 shows a dimetric perspective view of the housing and the selection mechanism locking device in a closed position (left) and open position (right), omitting part of the lock for clarity purposes.
Figure 9:
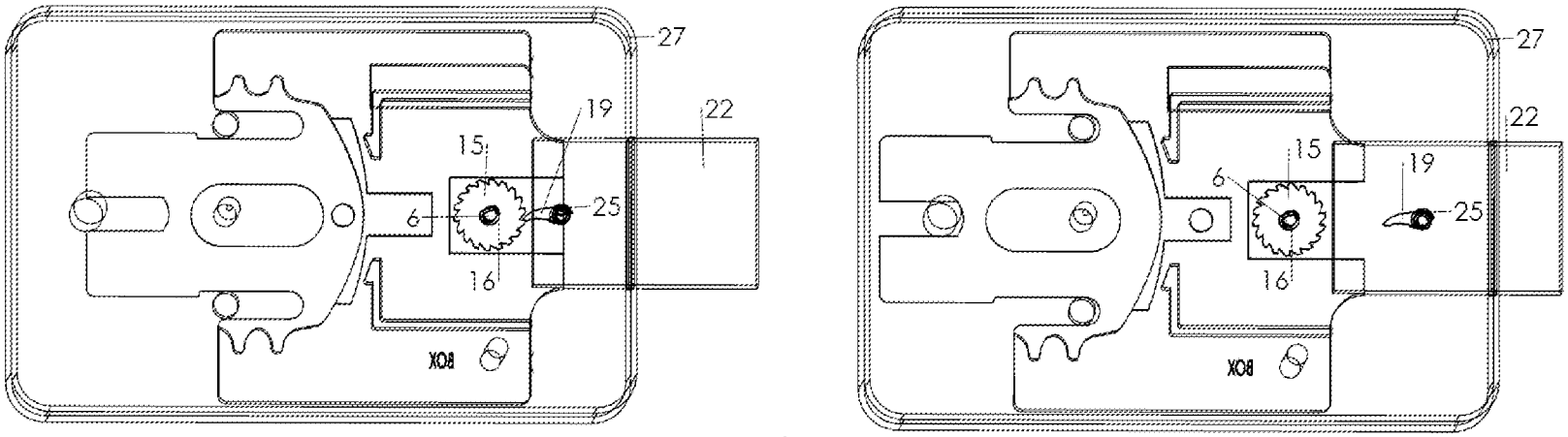
FIG. 9 is a perspective view of the back of the deadbolt and the device to lock the selection mechanism locking device in a closed position (left) and open position (right), omitting part of the lock for clarity purposes.

There is another guiding stem (24) in the lock housing (27) to place the closing pawl (19) (also called the levorotatory pawl), whose functionality is to lock the movement of the drive shaft (6) at the end of the deadbolt path (22), restricting the only allowed turning direction through the contact with the closing ratchet (15). Said closing ratchet is symmetrically assembled to the ratchet (14) and whose teeth are tilted in the other direction. A spring (25) is also installed on the guiding stem (24) of the housing (27) which forces contact with the closing ratchet (15). FIG. 8 shows the details of this mechanism in the closed and open position, and FIG. 9 shows the reverse of the housing (27) (transparent) and the deadbolt (22) with the turning restriction device, in the closed and open position. The drive shaft (6), the closing ratchet (15), and the closing washer (16) move together according to the deadbolt (22); and the guiding stem (24), the closing pawl (19) and the spring (25) are fixed to the housing (27) waiting for contact when the deadbolt (22) moves. When the lock is closed (left part of FIGS. 8 and 9), the device is activated to restrict the only-allowed turning movement of the drive shaft (6), (clockwise direction), by forcing the contact of the closing pawl (19) with the closing ratchet (15). Blocking occurs when both the clockwise and counterclockwise turning of the drive axis (6) have been restricted. When the lock is open (right side in FIGS. 8 and 9), one of the two turning directions is released, allowing the clockwise rotation of the drive shaft (6).

Figure 10:
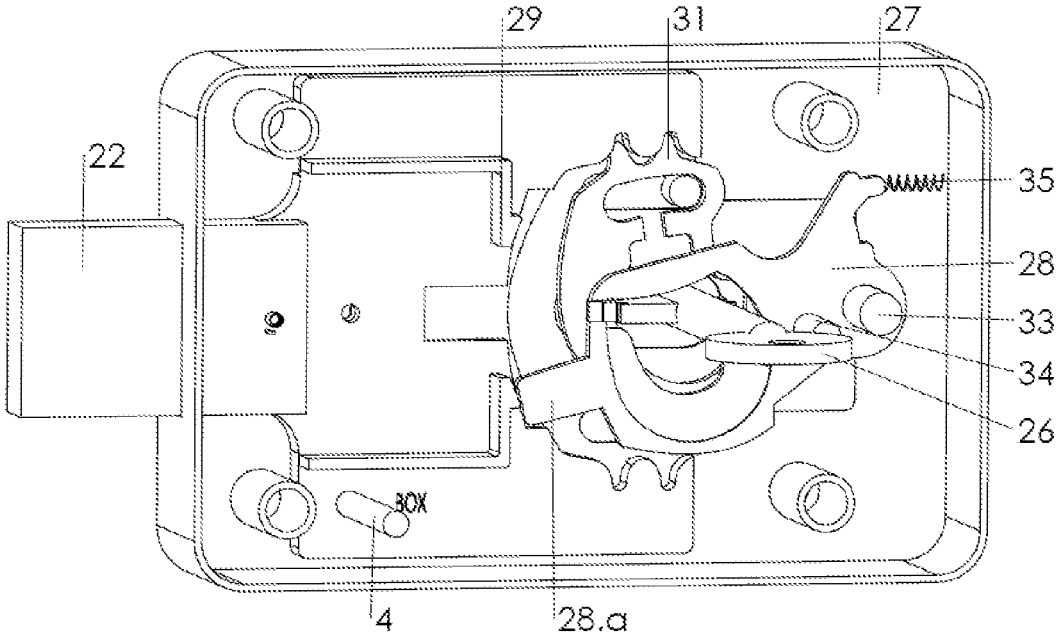
FIG. 10 is a perspective view of the mechanism that allows the lock to be opened with an authorized code key, omitting part of the lock for clarity purposes.
Figure 11:
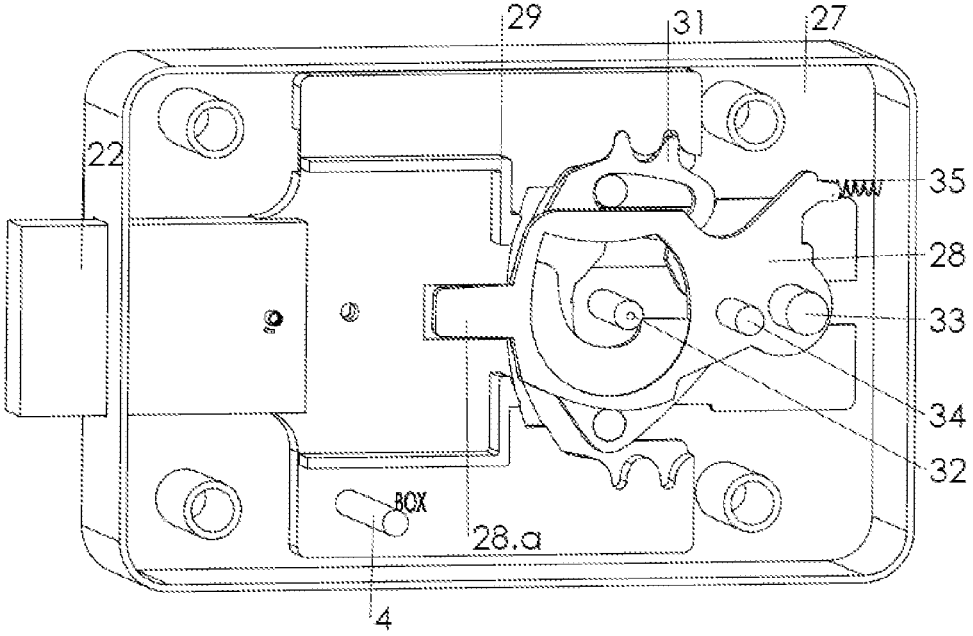
FIG. 11 is a perspective view of the mechanism that allows the lock to be manually closed and locked, omitting part of the lock for clarity purposes.

The code control piece (28), which operation is described in FIG. 10, rotates upwardly around stem (33) when the key (26) is inserted into the lock and is rotated 45°. The nose (**28.*a*) is inserted into the opening of the deadbolt in the housing (29) of the plates (17) waiting for the key to have the appropriate mechanical code and to be able to rotate the other 45° that is need to move the sliding part (31) of the deadbolt (22). Once opened and when the key (26) has been removed from the shank (32), as schematically shown in FIG. 11, the lock can be manually moved towards its closure by the closing rod (4). This is allowed by the nose shape (28** *a*) of the code control piece (28) without any obstruction additions that retain it in the deadbolt and that is necessary to release it with a key at the time of closing the lock. When the closing stem is moved (4) and closed, the spring (35) forces the control piece of the code (28) to rotate downwards around the stem (33).

Figure 12:
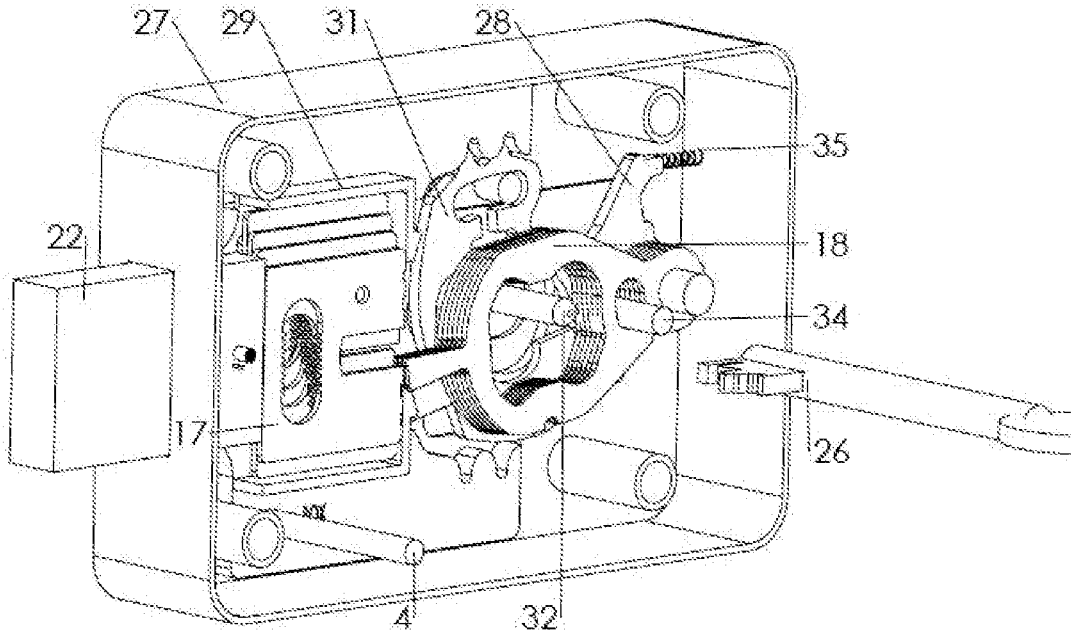
FIG. 12 is a perspective view of the lock mechanism in a closed position before inserting the key, omitting the lid and the selection devise for clarity purposes.
Figure 13:
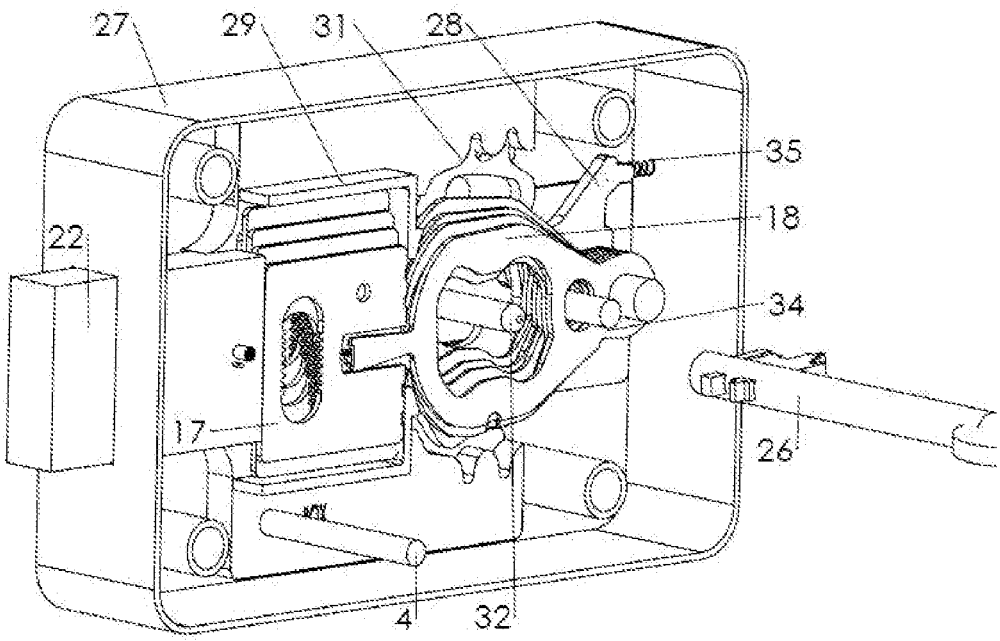
FIG. 13 is a perspective view of the lock mechanism in an open position after inserting the key, omitting the lid and the selection devise for clarity purposes.
Figure 14:
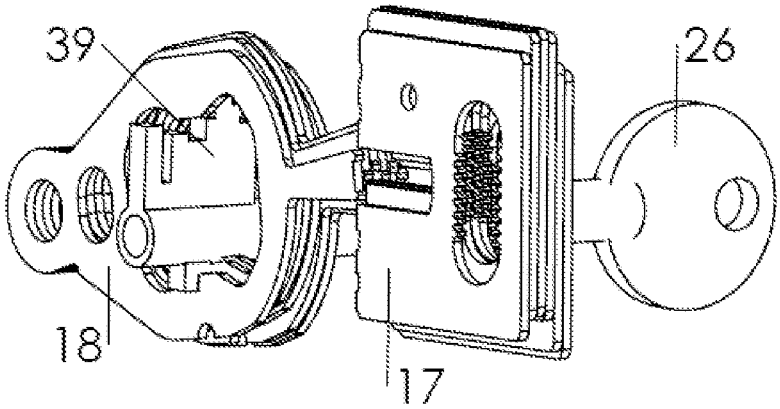
FIG. 14 is a perspective view showing in detail how the key, the interlocks and the plates are coupled, representing the moment in which the lock is opened, and omitting part of lock pieces for clarity purposes.

The code control part (28) has a column (34) that serves as a motion guide and placement in the waiting position of the interlock set (18), as depicted in FIG. 12. The key (26) has an inner cylindrical hole to be inserted into the stem (32) at the time of opening. If the key (26) has the appropriate mechanical code (39), the key teeth will lift each of the interlocks (18) to a certain position when the key is rotated 90° and will fit into the slits of the plates (17) which are waiting at the same combined height in the user selection, as shown in FIG. 14. When turning the key (26) to 135°, the deadbolt (22) will move towards the opening by the action of the sliding part (31) and, as is apparent from the observation in FIG. 13, when the key (26) reaches the 180° the deadbolt (22) will be fully open, each of the interlocks (18) will be inside the slits of the plates (17), the nose (28(*a*) of the code control piece (28) will fit into the deadbolt slit (22) and the key (26) can exit the stem (32).

In this position, when the lock is open, the closing rod (4) allows the manual movement of the deadbolt (22) towards the closing position. And in that movement, since the spring (35) forces the code control piece (28) to move downwards around the stem (33) it forces, in turn, to drop the interlock set (18) as a result of the same rotation and the column (34) inserted into the code control piece (28).

Through the hollow columns (30) and the lid (7) the lock is finally assembled, as shown in FIG. 1.

Figure 15:
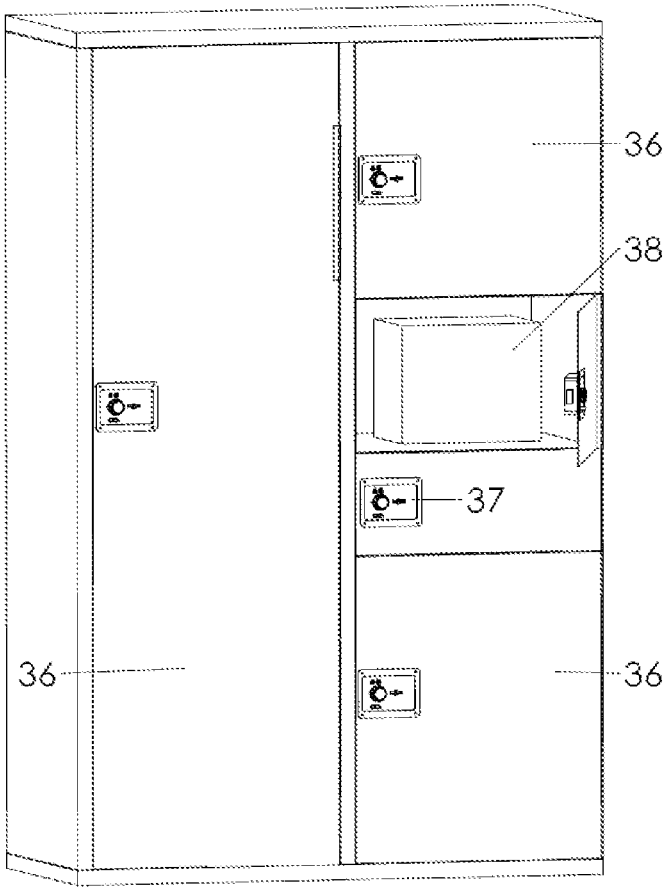
FIG. 15 is a perspective view of the locker modular system with an opened module door and a parcel inside.
Figure 16:
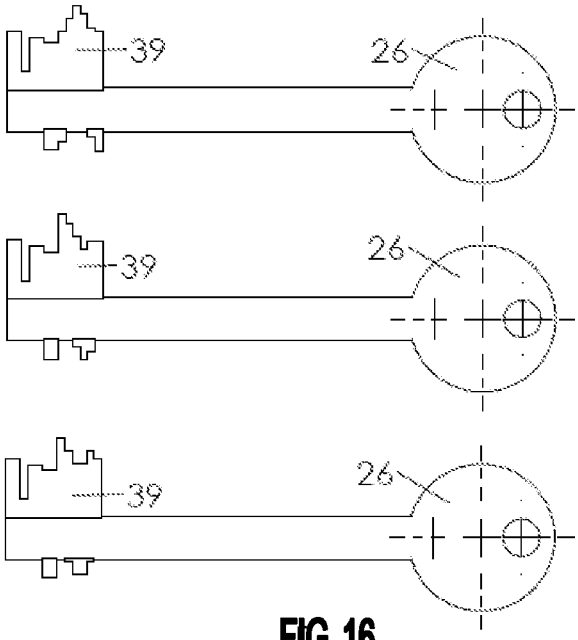
FIG. 16 shows an example of the different mechanical codes for the keys of each of the users who share the lock.

This lock (37), as shown in FIG. 15, is included in a modular variable dimension locker system, in which each compartment module (36) has the same lock. A key with different mechanical code (39) is assigned to each user, as shown in FIG. 16, sharing the modular system. The messenger places the parcel (38) in one of the lockers whose dimension is most appropriate to the volume of the parcel, selects the user to which the parcel is addressed with the selection knob (1) and with this element the different plates (17) are moved to a certain combined heights, the deadbolt (22) is manually moved with the rod (4) in the closing direction and locks the rotation of the selection knob (1) in both the clockwise and counterclockwise, as explained above. The selected user enters his key (26) with his mechanical code (39) and through each of his teeth, raises to the height coincident with the plates (17) each of the interlocks (18), as shown in FIG. 14, and opens the lock, opens the module (36) and collects the parcel (38).

INDICATION OF A WAY IN WHICH THE INVENTION IS SUSCEPTIBLE TO INDUSTRIAL APPLICATION

This invention is capable of industrial application and it can be manufactured by the corresponding industry in an obvious way, as described in FIG. 1 and the detailed description of a preferred embodiment.

What is claimed is:

1. A changeable lock for a parcel delivery and reception mechanical system, including a housing (27), a lid (7), a deadbolt (22) that includes a set of plates (17), a set of interlocks (18) located in front of the set of plates swinging around a stem (33), which by means of an authorized key (26) are ordered and coupled, characterized in that the lock is capable of being operated in a discriminated manner by a plurality of keys with different mechanical codes (39); a selection device (1) (6) (8.1) (8.2) (8.3) (8.4) (8.5) (8.6), to discriminate the authorized code, goes through the deadbolt (22) modifying the position of the plates (17) while waiting for the matching and coupling in the slits of the plates (17) of each of the interlocks (18) that lift the teeth of the authorized key (26); a rod (4) to manually move the deadbolt (22) from the outside of the lock to its closure; a mechanism to restrict the turning direction (15) of the selection device (1) (6) (8.1) (8.2) (8.3) (8.4) (8.5) (8.6); a mechanism to restrict the other turning direction (19) on the drive shaft (6) to lock the selection device which is operated at the time when the deadbolt path (22) is in the closed position; and a signaling mechanism (5) (2) (3) that depends on the point of the deadbolt displacement path (22), assembled in the selection device and in the lid (7) to make visible from the outside which mechanical code is authorized to open the lock.

2. The changeable lock for a parcel delivery and reception mechanical system, according to claim 1 characterized in that the plates (17) have a rectangular rounded-ends cogged hole (9) with a rack (10) driven by combination gears (8.1) (8.1) 8.2) (8.3) (8.4) (8.5) (8.6) including cogged arches (11) of different grades that are coupled to the rectangular rounded-ends hole (9).

3. The changeable lock for a parcel delivery and reception mechanical system, according to claim 2 characterized in that the authorized code selection device has a knob (1) actionable from outside of the lock and connected to an axle (6) that goes through the lid (7), a user wheel (5), the plates (17), the combination gears (8.1) (8.2) (8.3) (8.4) (8.5) (8.6), the deadbolt (22) and a fastening washer (16) which, as the degrees of rotation varies, produces a movement in the position of the plates (17) by which they move up and down within the plate housing (29).

4. The changeable lock for a parcel delivery and reception mechanical system, according to claim 3 characterized in that the axis (6) that moves the plates (17) has a movement restriction mechanism which comprises a ratchet (14) assembled to the axis (6) and a pawl (12) that forces the turn to rotate in one direction.

5. The changeable lock for a parcel delivery and reception mechanical system, according to claim 3 characterized in that the transmission shaft (6), that goes through the deadbolt (22) and the lid (7) and moves the knob (1), assembles a ratchet (15) driven by contact with a pawl (19) assembled in the housing (27) when the deadbolt (22) reaches the closing position, and whose function is to prevent the sole sense of rotation of the transmission shaft (6) and disable the knob (1) of the selection device completely.

6. The changeable lock for a parcel delivery and reception mechanical system, according to claim 1 characterized in that the lid (7) includes a slit (13) and the deadbolt (22) has a rod (4) that goes through it to move the deadbolt (22) from the outside in the closing direction.

7. The changeable lock for a parcel delivery and reception mechanical system, according to claim 1 characterized in that a set of lockers that shares users to collect the parcels (38) are integrated into modules (36) by an key (26) to open the lock and including a mechanical code (39) capable of being authorized.

* * * * *